US008695821B2

(12) United States Patent
Bashyam

(10) Patent No.: US 8,695,821 B2
(45) Date of Patent: Apr. 15, 2014

(54) CLOSURE HAVING IMPROVED PERFORMANCE

(75) Inventor: Navaneeth Bashyam, Crawfordsville, IN (US)

(73) Assignee: Closure Systems International Inc., Indianapolis, IN (US)

( * ) Notice: Subject to any disclaimer, the term of this patent is extended or adjusted under 35 U.S.C. 154(b) by 0 days.

(21) Appl. No.: 13/523,495

(22) Filed: Jun. 14, 2012

(65) Prior Publication Data

US 2012/0318768 A1 Dec. 20, 2012

Related U.S. Application Data

(60) Provisional application No. 61/496,895, filed on Jun. 14, 2011.

(51) Int. Cl.
*B65D 41/04* (2006.01)
*B65D 41/00* (2006.01)

(52) U.S. Cl.
USPC ..... 215/252; 215/305; 215/329

(58) Field of Classification Search
USPC ..... 215/252, 329, 305
See application file for complete search history.

(56) References Cited

U.S. PATENT DOCUMENTS

| | | | | |
|---|---|---|---|---|
| 4,261,478 | A * | 4/1981 | Summers | 220/270 |
| 4,638,917 | A * | 1/1987 | Persch | 215/252 |
| 4,909,404 | A * | 3/1990 | Rozenberg | 215/200 |
| 6,705,479 | B2 * | 3/2004 | Druitt et al. | 215/252 |
| 7,607,547 | B2 * | 10/2009 | Kumata et al. | 215/252 |
| 8,231,020 | B2 * | 7/2012 | Taber et al. | 215/305 |
| 2004/0011759 | A1 * | 1/2004 | Hahn et al. | 215/305 |
| 2008/0087625 | A1 * | 4/2008 | Kumata et al. | 215/252 |
| 2008/0105640 | A1 * | 5/2008 | Ott | 215/252 |
| 2013/0043207 | A1 * | 2/2013 | Luzzato et al. | 215/252 |

* cited by examiner

*Primary Examiner* — Anthony Stashick
*Assistant Examiner* — Niki Eloshway
(74) *Attorney, Agent, or Firm* — Wood, Phillips, Katz, Clark & Mortimer

(57) ABSTRACT

A plastic closure formed from polymeric materials in accordance with the present invention is configured for enhanced performance, including enhanced strength and impact resistance. In one aspect of the present invention, the closure includes a top wall portion, and an annular, depending skirt portion which defines a plurality of circumferentially spaced, axial columns. Notably, in accordance with the illustrated embodiment, each of these axial columns is provided by a group of gripping knurls provided on the exterior of the skirt portion, with each group of the gripping knurls having relatively shallow valleys between adjacent ones of the knurls.

11 Claims, 3 Drawing Sheets

CLOSURE HAVING IMPROVED PERFORMANCE

TECHNICAL FIELD

The present invention relates generally to closures molded from polymeric materials for use on bottles and like containers, and more particularly to a closure which is configurated for efficient use of polymeric material, with enhanced performance and ease of manufacturability.

BACKGROUND OF THE INVENTION

Closures molded from polymeric materials have met with widespread acceptance in the marketplace. Closures of this nature, which can be efficiently formed by compression molding or injection molding, are particularly suitable for use on bottles and like containers, including those having carbonated and non-carbonated contents.

Several important design criteria must be considered in connection with efficient and cost-effective use of these types of molded closures. Material savings is always desirable, since this facilitates cost-effective use of such closures. At the same time, the closures must be configured to exhibit the necessary strength and impact resistance, including the necessary resistance to deformation attendant to top-loading of the closures, such as during shipment and storage of stacked groups of containers.

In addition to meeting the necessary performance criteria, it is important that plastic closures be configured for efficient manufacture, such as attendant to formation by compression molding. During this formation process, internally threaded plastic closures are typically "stripped" from an associated male molding plunger, without any relative "unthreading" rotation. It is important that closures exhibit the requisite flexibility to permit removal from the associated molding apparatus in this fashion, while at the same time avoiding undesirable deformation of the molded closure.

Features of the present plastic closure provide enhanced, cost-effective performance, while facilitating high-speed manufacture.

SUMMARY OF THE INVENTION

Plastic closures configured in accordance with the present invention provide enhanced performance, while at the same time minimizing use of the polymeric material from which the closures are molded. Certain aspects of the present invention facilitate high-speed manufacture of the molded closures, while still providing the desired performance characteristics.

In accordance with one illustrated embodiment of the present invention, the present closure includes a closure cap having a top wall portion, and an annular skirt portion depending from the top wall portion, with the skirt portion having at least one internal thread formation. In this aspect of the present invention, the annular skirt portion defines a plurality of circumferentially spaced, vertically extending gripping knurls on the exterior surface of the skirt portion. A valley is defined between each adjacent pair of the gripping knurls.

This aspect of the present invention contemplates that the annular skirt portion of the closure cap defines a plurality of circumferentially spaced, axial columns. Notably, each of these axial columns is provided by a group of the gripping knurls (such as 4 to 6 gripping knurls) having relatively shallow ones of the valleys between adjacent knurls compared to valleys between gripping knurls of another group of gripping knurls adjacent to the axial column. By this arrangement, alternating groups of the gripping knurls have relatively shallow and relatively deep valleys between adjacent ones of the knurls of each group.

Each gripping knurl is defined by a peak between two valleys, with each peak defining an outermost surface of its respective gripping knurl. Each outermost surface is at the same radial distance from the interior surface of the annular skirt portion.

The present invention contemplates that the skirt portion of the closure cap includes between about 12 and about 24 of the circumferentially spaced axial columns. The axial columns provided by the groups of knurls having shallow valleys can be evenly spaced about the circumference of the closure, or asymmetrically positioned in order to strengthen and rigidify one or more selected regions of the closure skirt portion. Use of the present closure on a container having carbonated contents is facilitated by configuring the skirt portion of the closure cap to define a plurality of circumferentially spaced, gas-venting grooves extending axially along an inside surface of the skirt portion.

Thus, this aspect of the present invention provides a plurality of axial columns with radially thickened sections in the closure sidewall. These relatively thick columns maintain a raised core temperature at the point in time that the closure is ejected from the molding process. The raised core temperature desirably provides flexibility in the closure sidewall that enhances the ejection process. The remaining thin sections in the closure sidewall, located between the thickened columns, also provide a level of increased flexibility compared to a sidewall of the typical constant thickness. This also provides additional flexibility in the closure sidewall, and once again enhances the ejection process.

Upon application of the present closure to an associated container, the thickened columns in the closure sidewall provide energy absorption features that carry the brunt of any impact load encountered during container drops, and thus provide enhanced impact performance for the package.

In accordance with one illustrated embodiment, the present closure includes a closure cap having a top wall portion (sometimes referred to as the top panel), and an annular skirt portion (sometimes referred to as the sidewall) depending from the top wall portion. The annular skirt portion has at least one internal thread formation for engagement with an external thread formation on an associated container to which the closure is applied.

The top wall portion of the closure cap includes a central portion, and an annular, outer portion surrounding the central portion. Notably, the exterior surface of the top wall portion defines a stepped, exterior region joining the central portion and the annular portion.

In order to provide the present closure with the desired performance characteristics, the closure cap can include a plurality of circumferentially spaced, reinforcing knurls extending from the annular, outer portion of the top wall portion to the central portion thereof across the stepped, exterior region of the top wall portion. By this arrangement, the reinforcing knurls desirably enhance the stiffness and impact resistance of the closure.

In the illustrated embodiment, each of the reinforcing knurls has a generally wedge-shaped configuration, which tapers inwardly in a direction toward the central portion of the top wall portion. In an alternative embodiment, an inside surface of the top wall portion defines a stepped, interior region joining the central portion and the annular portion of the top wall portion.

Convenient manipulation of the present closure by consumers is facilitated by configuring the annular skirt portion of the closure cap to define a plurality of circumferentially spaced, vertically extending gripping knurls on the exterior surface of the skirt portion. In the illustrated embodiments, the reinforcing knurls extend generally upwardly and inwardly from the gripping knurls.

By providing reinforcement of the externally stepped region for the top wall portion of the closure cap in accordance with the present invention, the closure desirably exhibits increased resistance to "doming" of the top wall portion that typically occurs over time under the influence of internal gas pressure, and thermal loading.

The provision of the reinforcing knurls desirably acts to maximize the stiffness to weight ratio of the top wall portion, providing the increased stiffness necessary to protect the seal with an associated container under top loading, at a minimum weight. If desired, a closure in accordance with the present invention may be provided with reinforcing knurls, without the associated stepped top wall portion.

Another feature of the invention is the utilization of the reinforcing knurls that "wrap around" the external top corner radius of the closure, and intersect the stepped region in the top wall portion. The rib-like configuration of these reinforcing knurls provides additional stiffness in the top wall portion that results in improved performance under top loading. The reinforcing knurls also desirably provide improved impact performance of the closure on the associated container. The reinforcing knurls also enhance the ergonomics of the closure by enhancing the grip which can be applied to the closure by a consumer, desirably acting to minimize the force applied to the consumer's hand for a given opening torque.

DETAILED DESCRIPTION

Figure 1:
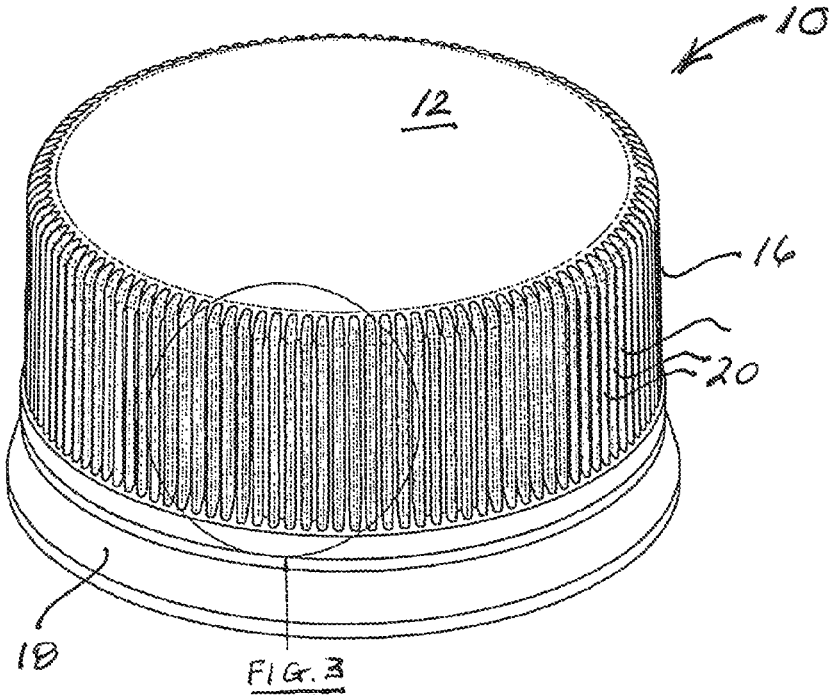
FIG. 1 is a perspective view of a closure embodying the principles of the present invention.

While the present is susceptible of embodiment in various forms, therein is shown in the drawings, and will herein after be described, presently preferred embodiments of the invention, with the understanding that the present disclosure is to be considered as an exemplification of the invention, and is not intended to limit the invention to the specific embodiments illustrated.

With reference now to FIGS. 1-4, therein is illustrated a closure 10 embodying the principles of one aspect of the present invention. Closure 10 can be suitably formed from polymeric materials by compression molding or injection molding, with this type of closure having been found to be particularly suitable for use on bottles and like containers, including those having carbonated and non-carbonated contents.

As shown, closure 10 comprises a closure cap having a top wall portion 12, and an annular skirt portion 14 depending from the top wall portion 12. Typically, the skirt portion 14 is provided with at least one internal thread formation for cooperative engagement with a like external thread formation on an associated container to which the closure is applied. In the illustrated embodiment, the closure includes a tamper-evident band 16, which is at least partially detachably connected to the skirt portion 16. The tamper-evident band is configured for cooperative engagement with the associated container to provide visually discernible evidence when the closure has been partially or completely removed from the associated container.

In order to facilitate manipulation of the closure by consumers, the exterior surface of the annular skirt portion 16 defines a plurality of circumferentially spaced, vertically extending gripping knurls 20. A valley is defined between each adjacent pair of the gripping knurls 20.

Figure 2:
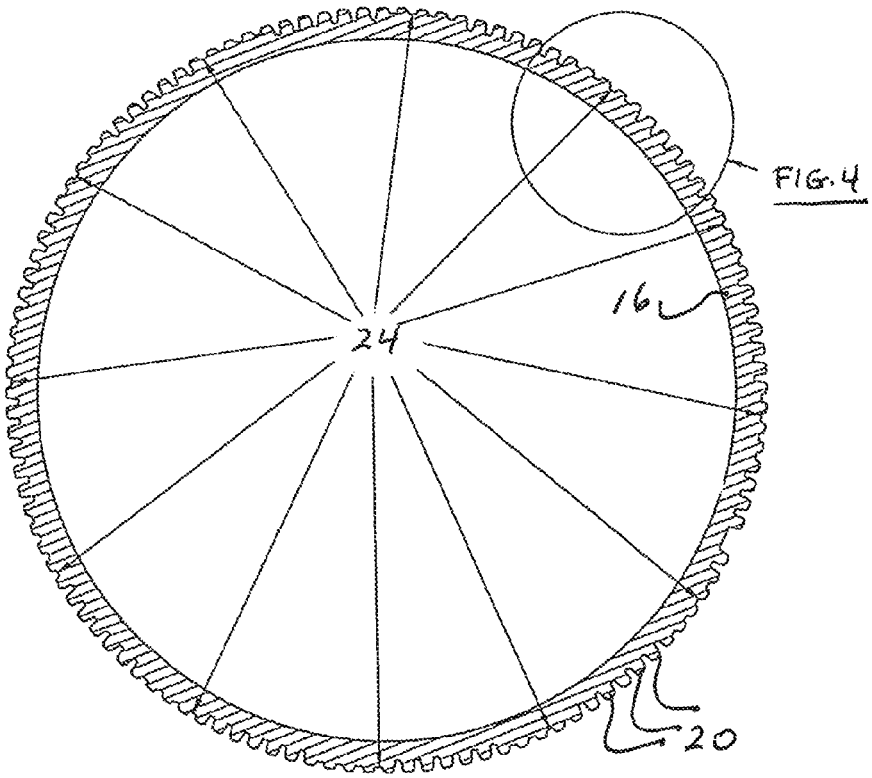
FIG. 2 is a diagrammatic, cross-sectional view of the closure shown in FIG. 1.
Figure 3:
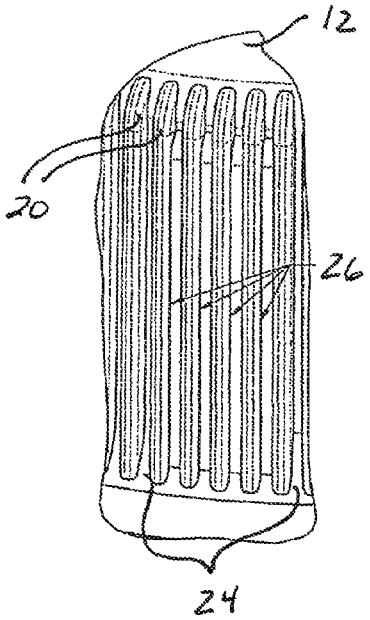
FIG. 3 is an enlarged, fragmentary perspective view of a portion of the closure shown in FIG. 1, as indicated by the circle therein.
Figure 4:
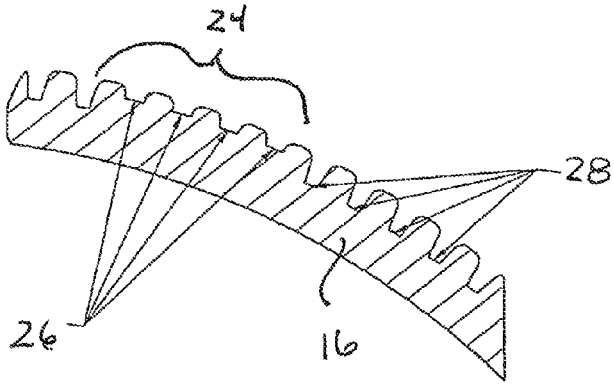
FIG. 4 is an enlarged, fragmentary view of the closure shown in FIG. 2, indicated by the circle therein.
Figure 5:
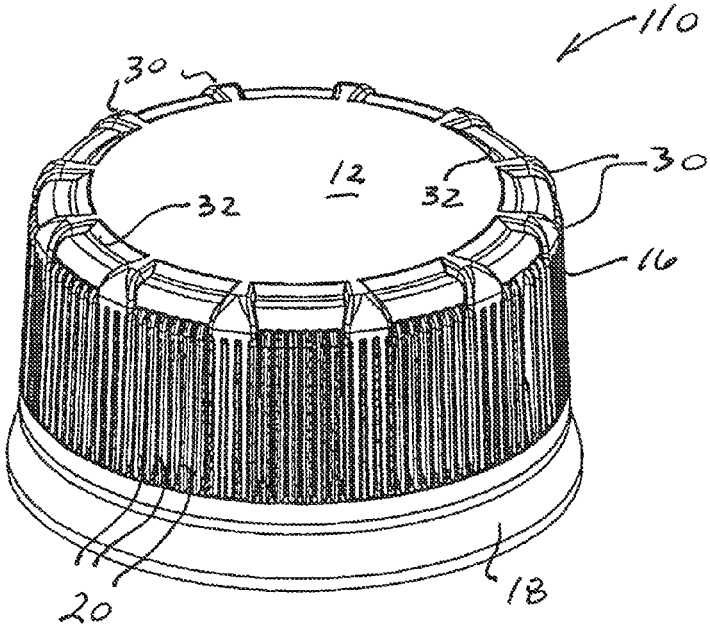
FIG. 5 is a perspective view of a closure having further features of the present invention.
Figure 6:
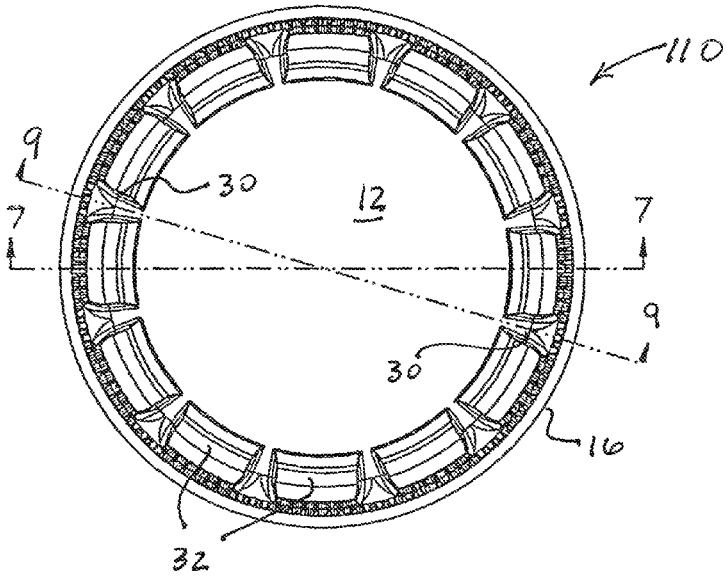
FIG. 6 is a top, plan view of the closure shown in FIG. 5.
Figure 7:
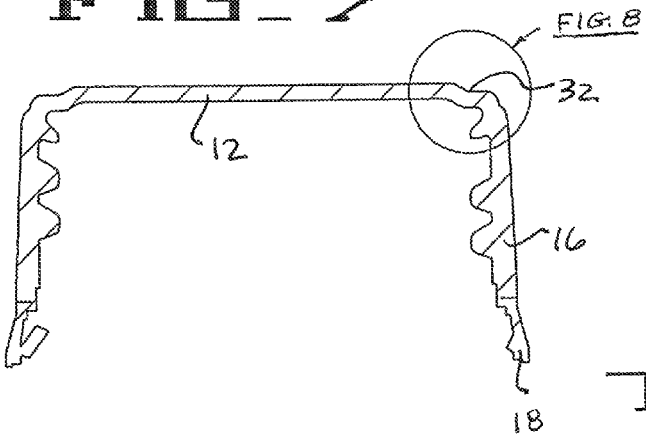
FIG. 7 is a diagrammatic, cross-sectional view taken along lines 7/7 of FIG. 6.
Figure 8:
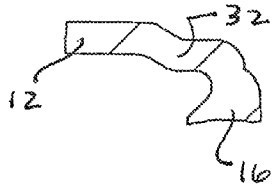
FIG. 8 is an enlarged, fragmentary view as indicated by the circle in FIG. 7.
Figure 9:
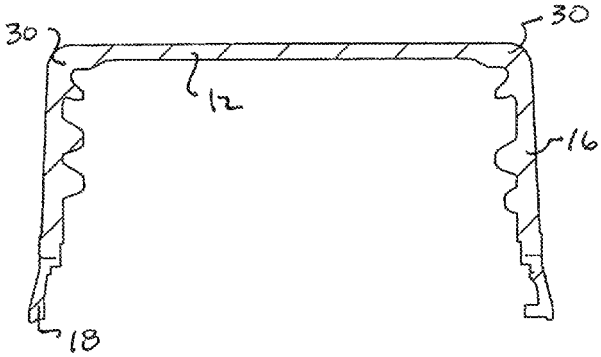
FIG. 9 is a diagrammatic, cross-sectional view taken along lines 9/9 of FIG. 6.

Notably, this aspect of the present invention contemplates that the annular skirt portion 16 of the closure cap defines a plurality of circumferentially spaced, axial columns, each designated 24 (see FIG. 2). Each of the axial columns 24 is provided by a group of the gripping knurls 20 (such as 4 to 6 gripping knurls), having relatively shallow ones 26 of the valleys between adjacent knurls 20. By this arrangement, alternating grou
of the gripping knurls 20 have relatively shallow valleys 26, and relatively deep valleys 28, between adjacent ones of the knurls 20 of each group. It is presently contemplated that the skirt portion 16 of the closure cap includes between about 12 and about 24 of the circumferentially spaced axial columns 24. The axial columns provided by the grou
of knurls 20 having shallow valleys 26 can be evenly spaced about the circumference of the closure 10, or asymmetrically positioned in order to strengthen and rigidify one or more selected regions of the closure skirt portion 16. Use of the present closure on a container having carbonated contents is facilitated by configuring the skirt portion 16 of the closure cap to define a plurality of circumferentially spaced, gas-venting grooves extending axial along an inside surface of the skirt portion 16.

Notably, this aspect of the present invention provides a plurality of axial columns with radially thickened sections in the closure sidewall. These relatively thick columns maintain a raised core temperature at the point in time that the closure is ejected from the associated molding apparatus. The raised core temperature desirably provides flexibility in the closure sidewall that enhances the injection process. The remaining relatively thin sections in the closure sidewall located between the thickened columns, also provide a level of increased flexibility, compared to a sidewall of a typical relatively constant thickness. This also desirably provides additional flexibility in the closure sidewall, and once again enhances the injection processes.

Notably, upon application of the present closure to an associated container, the thickened columns in the closure sidewall provide energy absorption features that carry the brunt of any impact load encountered during container drops, and thus provide enhanced impact performance for the closure and container package.

With reference now to FIGS. 5-9, therein is illustrated a further aspect of the present invention, as exemplified by closure 110, configured generally in accordance with previously-described closure 10. Thus, closure 110 includes a top wall portion or top panel 12, and an annular, depending skirt portion or sidewall 16, depending from the top wall portion. A plurality of circumferentially spaced, vertically extending gripping knurls 20 on the exterior surface of the skirt portion 16 facilitate manipulation of the closure by consumers.

Notably, this aspect of the present invention provides a plurality of circumferentially spaced reinforcing knurls 30 which each extend from an annular, outer portion of the top wall portion 12 to a central portion thereof across a stepped, exterior region of the top wall portion, shown at 32. In accordance with the illustrated embodiment, each of the reinforcing knurls 30 has a generally wedge-shaped configuration, which tampers inwardly in a direction toward the central portion of the top wall portion 12. In the illustrated embodiment, the stepped portion 32 of the top wall portion 12 is defined generally at the exterior juncture of the top wall portion and the skirt portion, but alternatively, the stepped portion of the sidewall can be defined by a stepped, interior region joining the central portion and the annular portion of the top wall to each other.

As noted, convenient manipulation of the present closure by consumers is facilitated by configuring the annular skirt portion 16 of the closure to define the plurality of circumferentially spaced vertically extending gripping knurls 20 on the exterior of the skirt portion. In the illustrated embodiment, the reinforcing knurls 30 extend generally and upwardly and inwardly from the gripping knurls 20.

By providing reinforcement of the externally stepped region for the top wall portion of the closure cap, in accordance with the present invention, the closure desirably exhibits increased resistance to "doming" of the top wall portion that typically occurs over time under the influence of internal gas pressure, and thermal loading.

The provision of the reinforcing knurls 30 desirably acts to maximize the stiffness-to-weight ratio of the top wall portion 12, providing the increased stiffness necessary to protect the seal with an associated container under top loading, at a minimal weight. If desired, a closure in accordance with the present invention may be provided with reinforcing knurls, without the associated stepped top wall portion.

Another feature of the invention is the utilization of the reinforcing knurls 30 that "wrap around" the external top corner radius of the closure, and intersect the stepped region in the top wall portion 12. The rib-like configuration of these reinforcing knurls 30 provides additional stiffness in the top wall portion 12 that desirably results in improved performance under top loading. The reinforcing knurls 30 also desirably provide improved impact performance of the closure on the associated container. The reinforcing knurls 30 also enhance the ergonomics of the closure by enhancing the grip which can be applied to the closure by a consumer, desirably acting to minimize the force applied to the consumer's hand for a given opening torque.

From the foregoing, it will be observed that numerous modifications and variations can be effected without departing from the true spirit and scope of the novel concept of the present invention. It is to be understood that no limitation with respect to the specific embodiments illustrated herein is intended or should be inferred. The disclosure is intended to cover, by the appended claims, all such modifications as fall within the scope of the claims.

What is claimed is:

1. A closure for a container, comprising:

a top wall portion, and an annular skirt portion depending from said top wall portion, said annular skirt portion having at least one internal thread formation on an interior surface of the annular skirt for engagement with an external thread formation on an associated container, said annular skirt portion defining a plurality of circumferentially spaced, vertically extending gripping knurls on the exterior surface of said skirt portion, with a valley defined between each adjacent pair of said gripping knurls, said annular skirt portion defining a plurality of circumferentially spaced axial columns each comprising a radially thickened section of said annular skirt portion, each of said axial columns defined by a group of said gripping knurls having valleys between adjacent knurls, said columns adjacent to another group of gripping knurls with valleys between adjacent knurls, wherein valleys in the columns are radially shallower than valleys between the gripping knurls on the another group of gripping knurls.

2. A closure in accordance with claim 1, wherein said skirt portion of said closure cap includes between about 12 and about 24 of said circumferentially spaced axial columns.

3. A closure in accordance with claim 1, wherein said closure cap includes a plurality of circumferentially spaced, reinforcing knurls extending from an annular, outer portion of said top wall portion to a central portion thereof for enhancing the stiffness and impact resistance of the closure.

4. A closure in accordance with claim 3, wherein each of said reinforcing knurls has a generally wedge-shaped configuration which tapers inwardly in a direction toward said central portion of said top wall portion.

5. A closure in accordance with claim 3, wherein said reinforcing knurls extending generally upwardly and inwardly from said gripping knurls.

6. A closure in accordance with claim 1, wherein said top wall portion of said closure cap includes a central portion, and an annular, outer portion surrounding said central portion, wherein an exterior surface of said top wall portion defines a stepped, exterior region joining said central portion and said annular portion.

7. The closure according to claim 1 wherein each gripping knurl is defined by a peak between two valleys, said peak comprising an outermost surface of the gripping knurl, and wherein each said outermost surface of the gripping knurl is the same radial distance from the interior surface of the annular skirt portion.

8. A closure for an associated container, comprising:

a one-piece closure cap having a top wall portion, and an annular skirt portion depending from said top wall portion, said annular skirt portion having at least one internal thread formation for engagement with an external thread formation on an associated container, said top wall portion of said closure cap including a central portion, and an annular, outer portion surrounding said central portion, wherein an exterior surface of said top wall portion defines a stepped, exterior region joining said central portion, and said annular, outer portion, said closure cap including a plurality of unitary, circumferentially spaced, reinforcing knurls extending from said annular, outer portion of said top wall portion across said stepped region to said central portion thereof for enhancing the stiffness and impact resistance of the closure.

9. A closure in accordance with claim 8, wherein each of said reinforcing knurls has a generally wedge-shaped configuration which tapers inwardly in a direction toward said central portion of said top wall portion.

10. A closure in accordance with claim 8, wherein said annular skirt portion defines a plurality of circumferentially spaced, vertically extending gripping knurls on the exterior surface of said skirt portion, said reinforcing knurls extending generally upwardly and inwardly from said gripping knurls.

11. A closure in accordance with claim 10, wherein said skirt portion of said closure cap defines a plurality of circumferentially spaced, gas-venting grooves extending axially along an inside surface of said skirt portion.

* * * * *